US011767184B2

(12) United States Patent
Maeda et al.

(10) Patent No.: US 11,767,184 B2
(45) Date of Patent: Sep. 26, 2023

(54) FEEDER AND IMAGE FORMING APPARATUS

(71) Applicant: FUJIFILM Business Innovation Corp., Tokyo (JP)

(72) Inventors: Shoichi Maeda, Kanagawa (JP); Masahito Niwa, Kanagawa (JP); Yuichi Araki, Kanagawa (JP); Yoshiki Kimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 128 days.

(21) Appl. No.: 17/225,120

(22) Filed: Apr. 8, 2021

(65) Prior Publication Data

US 2022/0082978 A1 Mar. 17, 2022

(30) Foreign Application Priority Data

Sep. 11, 2020 (JP) ..... 2020-153093

(51) Int. Cl.

| | |
|---|---|
| ***B65H 3/48*** | (2006.01) |
| ***G03G 15/00*** | (2006.01) |
| ***B65H 1/18*** | (2006.01) |
| ***B65H 1/14*** | (2006.01) |
| ***B65H 3/08*** | (2006.01) |
| ***B65H 7/02*** | (2006.01) |

(52) U.S. Cl.

CPC ..... *B65H 3/48* (2013.01); *B65H 1/14* (2013.01); *B65H 1/18* (2013.01); *B65H 3/0833* (2013.01); *B65H 7/02* (2013.01); *G03G 15/6511* (2013.01); *B65H 2511/11* (2013.01)

(58) Field of Classification Search

CPC ... B65H 1/04; B65H 1/14; B65H 1/18; B65H 1/26; B65H 3/48; B65H 7/02; B65H 7/04; B65H 2405/15; B65H 2511/11; B65H 2701/11312

See application file for complete search history.

(56) References Cited

U.S. PATENT DOCUMENTS

| | | | | |
|---|---|---|---|---|
| 9,359,157 | B2 * | 6/2016 | Niikura | B65H 1/18 |
| 10,494,207 | B2 * | 12/2019 | Niikura | B65H 1/04 |
| 2015/0220054 | A1 * | 8/2015 | Otsuka | B65H 3/0816 271/18.1 |
| 2021/0061592 | A1 * | 3/2021 | Ikeda | B65H 1/04 |
| 2021/0061596 | A1 * | 3/2021 | Kimura | B65H 3/06 |

FOREIGN PATENT DOCUMENTS

| | | |
|---|---|---|
| JP | 2016000653 | 1/2016 |

* cited by examiner

*Primary Examiner* — Prasad V Gokhale
(74) *Attorney, Agent, or Firm* — JCIPRNET

(57) ABSTRACT

A feeder includes a body, a mount portion disposed in the body to support from below part of recording media stacked thereon, a lift that raises the mount portion, a support portion connected to the body to support from below another part of the recording media while the mount portion is raised, the support portion being located higher than a position of a mount surface of the mount portion while the recording media are stacked on the mount portion, a blowing portion that blows air between the recording media stacked on the mount portion, and a transport portion that transports the recording media stacked on the mount portion.

18 Claims, 13 Drawing Sheets

FEEDER AND IMAGE FORMING APPARATUS

CROSS-REFERENCE TO RELATED APPLICATIONS

This application is based on and claims priority under 35 USC 119 from Japanese Patent Application No. 2020-153093 filed Sep. 11, 2020.

BACKGROUND

(i) Technical Field

The present disclosure relates to a feeder and an image forming apparatus.

(ii) Related Art

Japanese Unexamined Patent Application Publication No. 2016-000653 discloses a sheet feeder that includes a housing, a feed tray that includes a mount plate for receiving sheets and that is slidably attached to the inside and outside of the housing, a transport device that transports sheets stacked on the mount plate in a direction orthogonal to both the sliding direction of the feed tray and a sheet-stack direction, and an elongation option removably attached to the upstream side of the mount plate in the transportation direction and including an extension plate serving as an extension of the mount plate to receive a long-size sheet. The sheet feeder includes a first locking device that is capable of holding the feed tray in a first locking position where the feed tray is not slidable in response to attachment of the elongation option thereto, and that is capable of holding the feed tray in a first unlocking position where the feed tray is slidable in response to detachment of the elongation option therefrom.

In, for example, a structure where air is blown to sheets from a blowing portion, when the sheets stacked are long sheets and a portion of the long sheets that protrudes beyond a mount portion to the extended portion sags, the long sheets may prevent air from flowing to the portion on the extended portion, which may cause a problem in sheet transportation, such as transportation in an overlapped manner.

SUMMARY

Aspects of non-limiting embodiments of the present disclosure relate to provide a feeder and an image forming apparatus that further prevent transportation of recording media in an overlapped manner than in a structure where a support portion supports the recording media below a mount portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a feeder that includes a body, a mount portion disposed in the body to support from below part of recording media stacked thereon, a lift portion that raises the mount portion, a support portion connected to the body to support from below another part of the recording media while the mount portion is raised, the support portion being located higher than a position of a mount surface of the mount portion while the recording media are stacked on the mount portion, a blowing portion that blows air between the recording media stacked on the mount portion, and a transport portion that transports the recording media stacked on the mount portion.

BRIEF DESCRIPTION OF THE DRAWINGS

Exemplary embodiments of the present disclosure will be described in detail based on the following figures, wherein.

DETAILED DESCRIPTION

Figure 1:
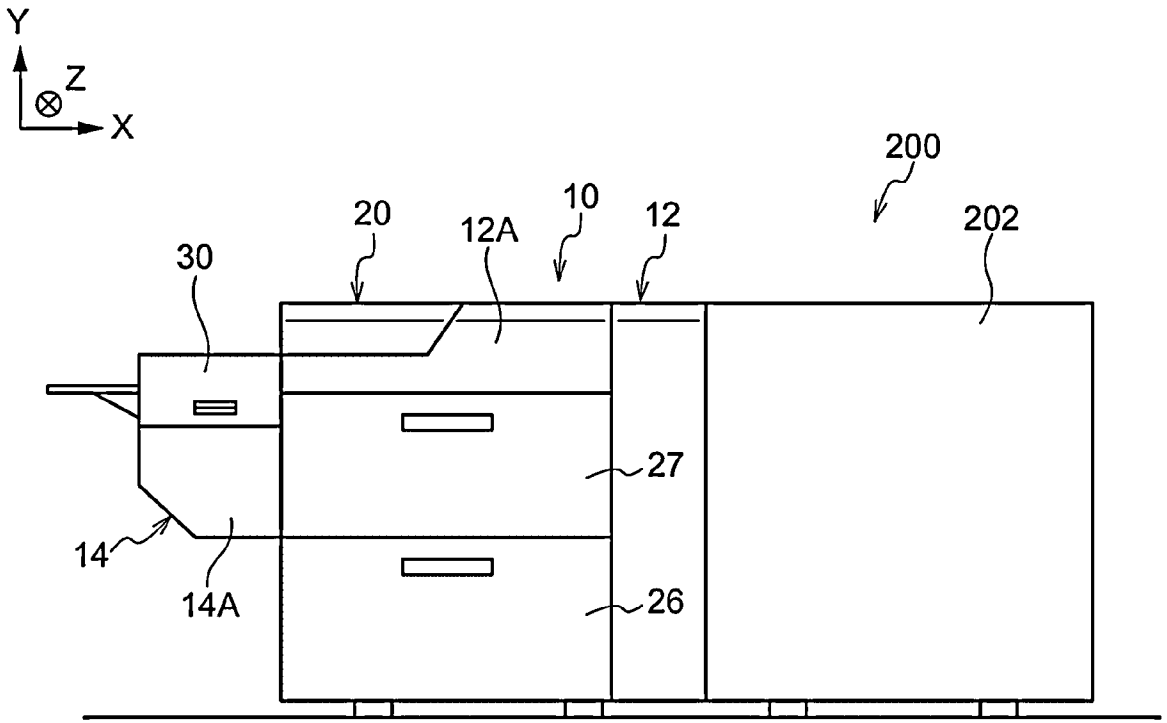
FIG. 1 is a front view of an image forming apparatus including a sheet feeder according to a first exemplary embodiment.

Embodiments of the technology of the present disclosure will be described below. In the following description, in the drawings illustrated as appropriate, the direction indicated with arrow X is defined as an apparatus width direction and the direction indicated with arrow Y is defined as an apparatus height direction. The direction (direction of arrow Z) orthogonal to the apparatus width direction and the apparatus height direction is defined as an apparatus depth direction.

First Exemplary Embodiment

Structure of Image Forming Apparatus

FIG. 1 is a front view of an example of an image forming apparatus 200 including a sheet feeder 10 according to a first exemplary embodiment.

As illustrated in FIG. 1, the image forming apparatus 200 includes an image forming apparatus body 202, which serves as an example of an image forming unit that forms images on recording media, and a sheet feeder 10, which feeds recording media to the image forming apparatus body 202. The sheet feeder 10 is an example of a feeder. The sheet feeder 10 is disposed beside the image forming apparatus body 202. Although not illustrated, the image forming apparatus 200 includes, inside the image forming apparatus body 202, an image forming device that forms images on recording media and a transportation device that transports recording media to the image forming device. The structures and the layout of the image forming device and the transportation device are not limited to particular ones. The sheet feeder 10 is optionally attached to the image forming apparatus body 202, and tradable alone in the market.

Structure of Sheet Feeder

Entire Structure

Figure 2:
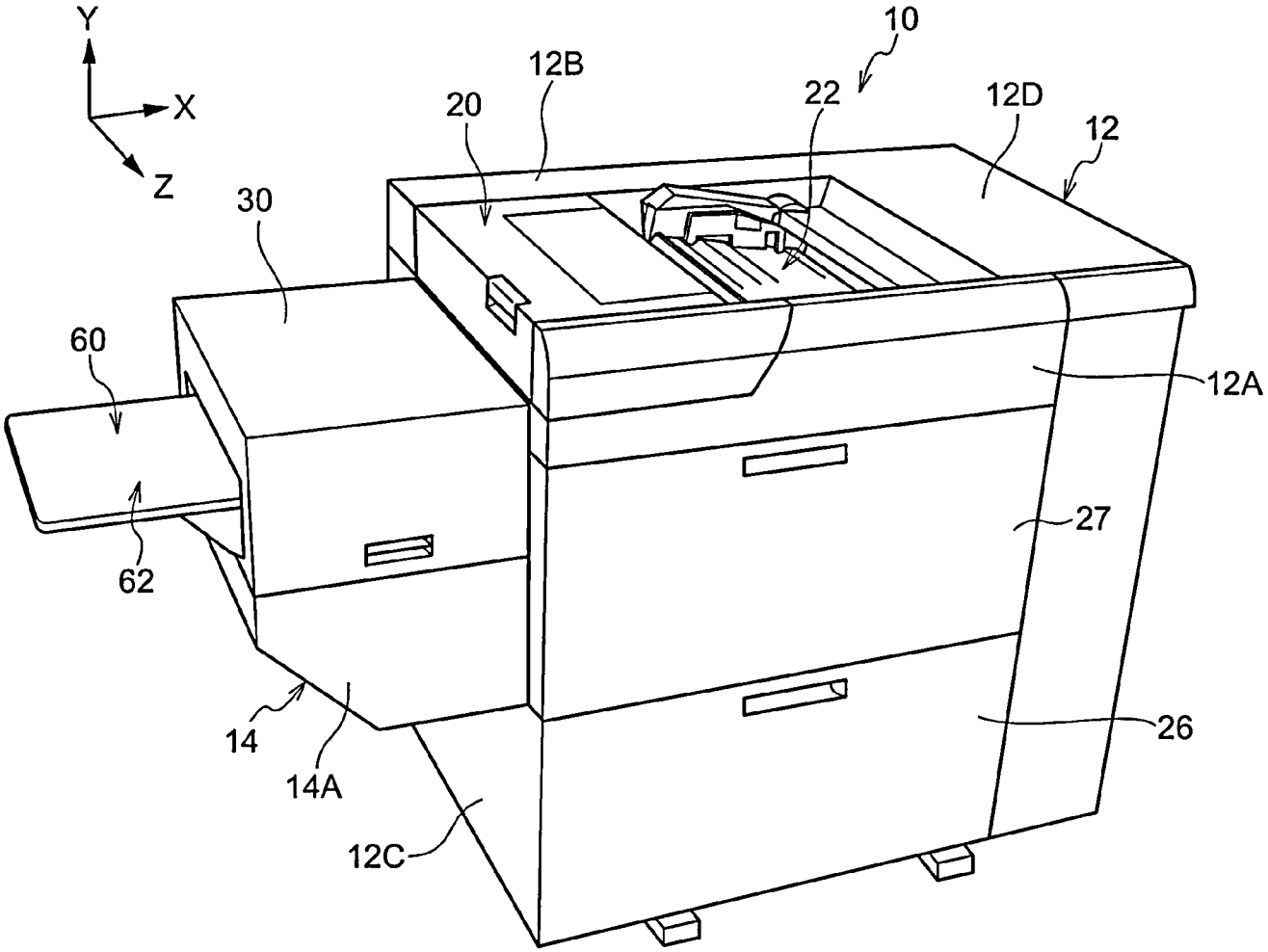
FIG. 2 is a perspective view of the sheet feeder according to the first exemplary embodiment.
Figure 3:
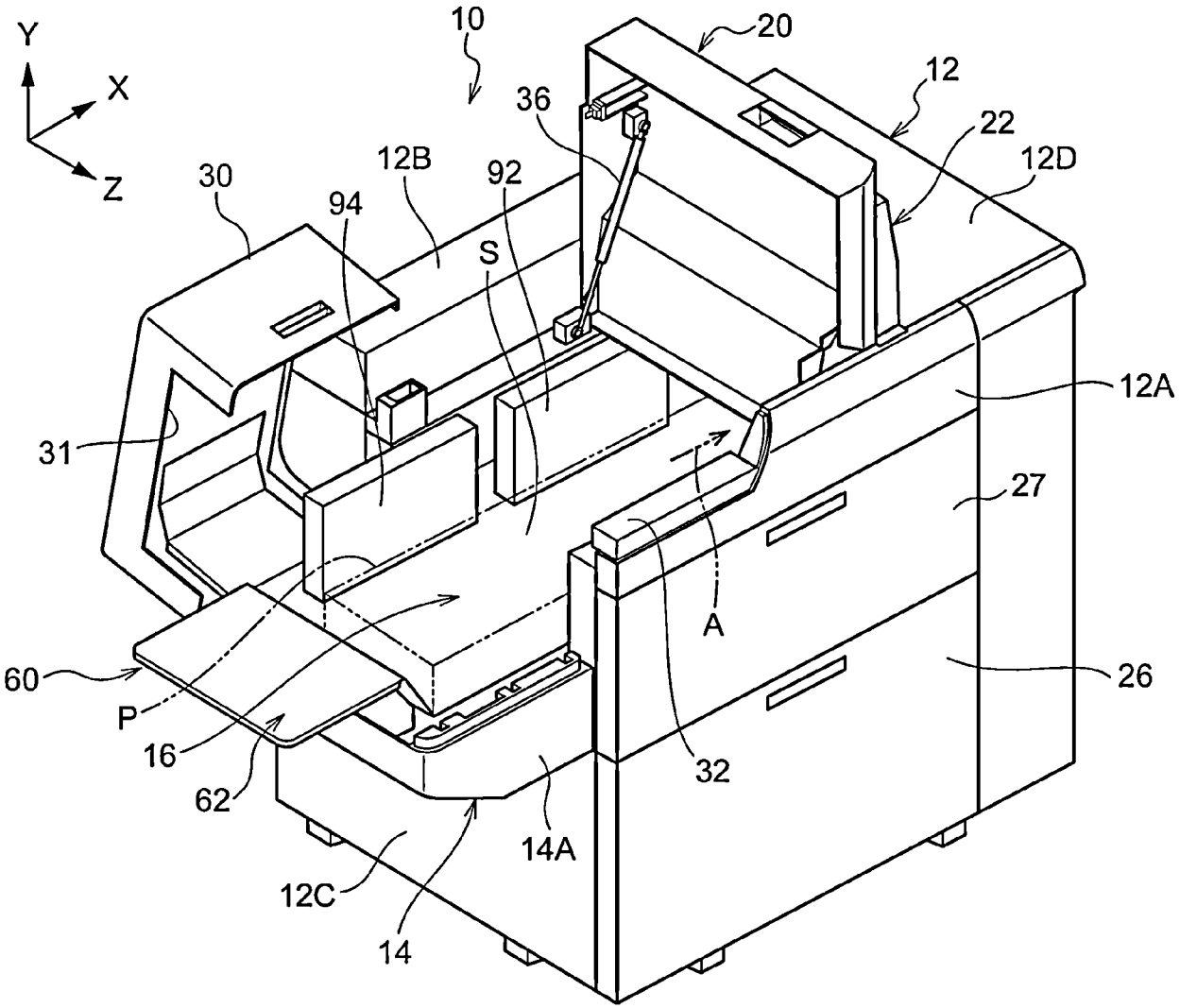
FIG. 3 is a perspective view of an open-close member and a rotation member included in the sheet feeder according to the first exemplary embodiment rotated to open a mount space over a mount portion.

FIG. 2 is a perspective view of the sheet feeder 10 according to the first exemplary embodiment. As illustrated in FIG. 2, the sheet feeder 10 includes a body 12, serving as an example of a housing, and a container device 14, attached to protrude outward from the side of the body 12. As illustrated in FIG. 3, the sheet feeder 10 includes, inside thereof, a mount portion 16 that receives multiple recording media P, and a mount space S above the mount portion 16 (refer to FIG. 3). The container device 14 is an example of a containing member removably attached to the body 12. The container device 14 is optionally retrofitted to the sheet feeder 10.

As illustrated in FIGS. 2 and 3, the sheet feeder 10 includes an open-close member 20 located on the upper surface of the body 12 to close the upper side of the mount portion 16. The open-close member 20 opens or closes the mount space S in the body 12 over the mount portion 16. The sheet feeder 10 includes a damper 36, which assists the operation of the open-close member 20 opening the mount space S (refer to FIG. 3). The sheet feeder 10 includes a rotation member 22, which is rotatable and at least part of which overlaps the open-close member 20. The rotation member 22 is capable of receiving manually inserted recording media while overlapping the open-close member 20. At a portion of the container device 14 protruding from the side of the body 12, an open-close covering 30 that opens or closes the mount space S over the mount portion 16 is disposed.

The sheet feeder 10 includes, in an upper portion of the mount space S, a transport portion 80 (refer to FIGS. 5 and 8) that transports the uppermost one of the multiple recording media P stacked on the mount portion 16. The transport portion 80 transports the recording media P stacked on the mount portion 16 one by one in the transportation direction (direction of arrow A) parallel to the apparatus width direction, as illustrated in FIG. 3.

Figure 4:
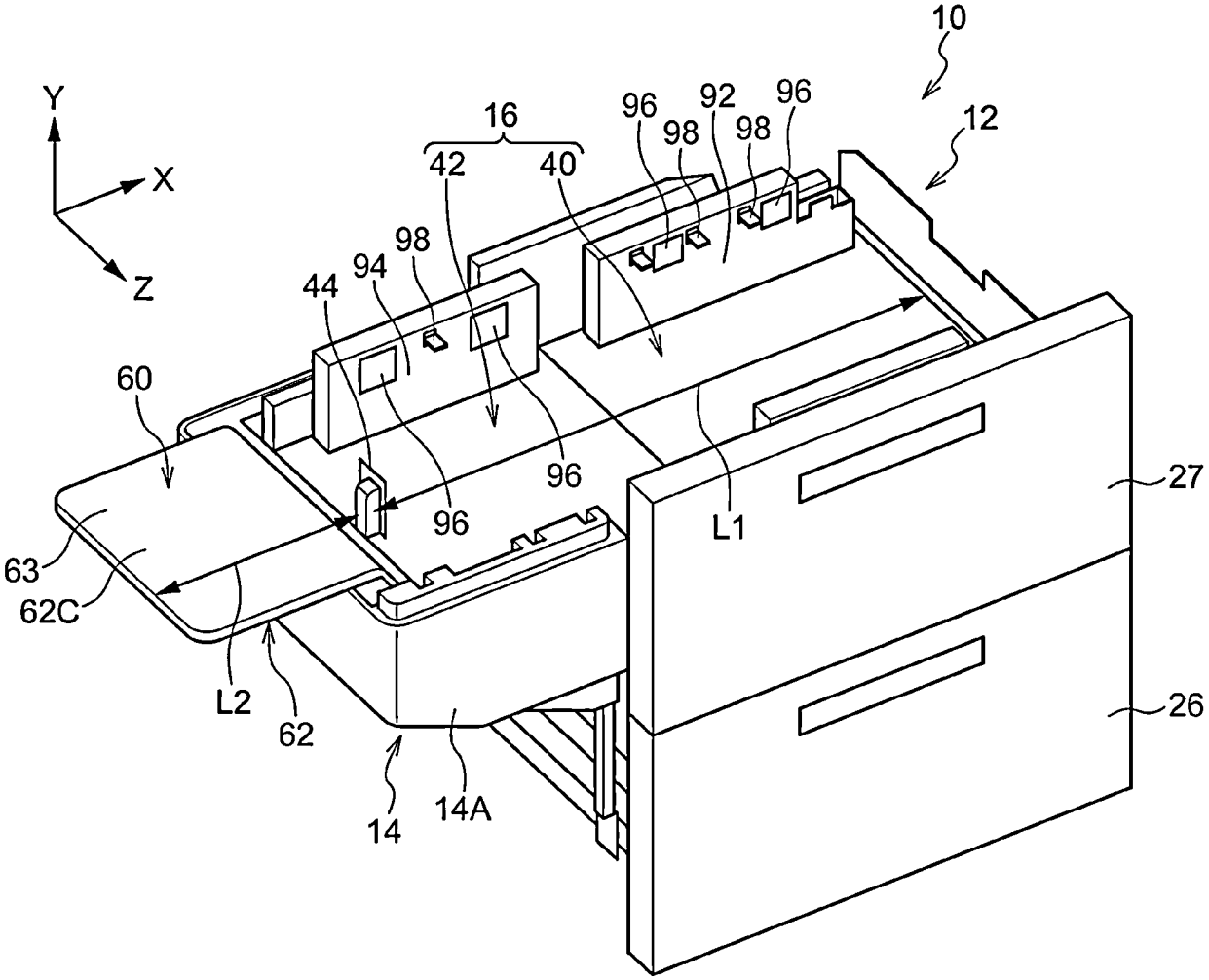
FIG. 4 is a perspective view of the mount portion and a support portion included in the sheet feeder according to the first exemplary embodiment.

As illustrated in FIG. 4, the sheet feeder 10 includes blowing portions 96, which blow air from the ends, in the direction crossing the transportation direction, of the multiple recording media P stacked on the mount portion 16, and sensors 98, which detect the position of the uppermost one of the recording media P stacked on the mount portion 16. The sheet feeder 10 also includes, near the transport portion 80, a blowing portion 88 (refer to FIG. 5), which blows air to the recording media P stacked on the mount portion 16.

As illustrated in FIGS. 2 and 3, the sheet feeder 10 also includes a drawable tray 26 at a lower portion of the body 12 on the front side in the depth direction (that is, Z direction). The drawable tray 26 accommodates a recording medium (not illustrated) having a size different from that of the recording media P. The drawable tray 26 is drawn out from the body 12 to accommodate the recording medium (not illustrated) having a size different from the recording media P.

Structure of Body 12

As illustrated in FIGS. 2 and 3, the body 12 serves as a housing of the sheet feeder 10. The body 12 includes a front wall 12A disposed at the front in the apparatus depth direction (that is, the Z direction), and a rear wall 12B disposed at the rear in the apparatus depth direction. The body 12 includes a side wall 12C disposed on a first side in the apparatus width direction (that is, X direction), and a side wall (not illustrated in FIG. 2) disposed on a second side in the apparatus width direction. The front wall 12A includes multiple panels. The drawable tray 26 is disposed over the range excluding the upper portion of the front wall 12A and the second side of the front wall 12A in the apparatus width direction.

The sheet feeder 10 also includes a drawable tray 27 at the front of the body 12 in the depth direction (that is, Z direction) above the drawable tray 26. When the container device 14 is mounted on the body 12, the drawable tray 27 is locked by a locking mechanism (not illustrated) not to be drawn to the near side with respect to the front wall 12A. When the container device 14 is not mounted on the body 12, the drawable tray 27 is drawable to the near side with respect to the front wall 12A to accommodate therein recording media P2 (refer to FIG. 7) with a size different from that of the recording medium P.

The body 12 also includes an upper wall 12D, disposed above the front wall 12A, the rear wall 12B, the side wall 12C, and another side wall (not illustrated in FIG. 2). The front wall 12A and the rear wall 12B are connected to the upper wall 12D at the upper ends, and part of the mount space S is covered with the upper wall 12D.

The front wall 12A and the rear wall 12B hold the mount space S over the mount portion 16 therebetween from both sides in the direction crossing the transportation direction of the recording media P, that is, in the apparatus depth direction indicated with arrow Z. The front wall 12A includes a cut portion 32 at a portion away from a portion near the upper wall 12D and having a lower height than a portion connected to the upper wall 12D (refer to FIG. 3). The body 12 includes, inside thereof, a body-side mount portion 40, constituting part of the mount portion 16 (refer to FIGS. 4 and 5). The body-side mount portion 40 will be described later.

Structure of Container Device 14

The container device 14 has a function of accommodating multiple recording media P. As illustrated in FIGS. 2 and 3, the container device 14 protrudes outward from the upper portion of the side wall 12C of the body 12. The container device 14 extends from a position between the front wall 12A and the rear wall 12B and on the outer side of the side wall 12C. Specifically, the container device 14 is removably attached to a portion between the front wall 12A and the rear wall 12B of the body 12 and above the side wall 12C. The container device 14 includes a body 14A and the open-close covering 30 disposed over the body 14A.

Inside the container device 14, an extension-side mount portion 42 is disposed. The extension-side mount portion 42 constitutes part of the mount portion 16 that receives the multiple recording media P (refer to FIG. 3). The extension-side mount portion 42 will be described later.

In the sheet feeder 10, the transport portion 80 (refer to FIGS. 5 and 8) disposed inside the body 12 near the upper wall 12D transports the recording media P stacked on the mount portion 16 one by one in the direction of arrow A. The mount portion 16 protrudes upstream in the transportation direction of the recording media P (that is, in direction of arrow A) from a position between the front wall 12A and the rear wall 12B. Specifically, in the sheet feeder 10, an upper portion of the side wall 12C between the front wall 12A and the rear wall 12B is open toward the upstream side in the transportation direction of the recording media P, and the mount portion 16 is disposed over the open portion.

The open-close covering 30 is rotated in the apparatus depth direction (that is, Z direction) with a hinge (not illustrated) disposed on the far side in the apparatus depth direction of the body 14A (refer to FIG. 3). When the open-close covering 30 is rotated upward from the near side to the far side in the apparatus depth direction (Z direction), part of the mount space S over the mount portion 16 is opened.

Structure of Open-Close Member 20 and Rotation Member 22

The open-close member 20 has a function of opening the mount space S over the mount portion 16 while sharing the covering area with the open-close covering 30, to allow the multiple recording media P to be placed on the mount portion 16. As illustrated in FIGS. 2 and 3, the open-close member 20 is disposed between upper portions of the front wall 12A and the rear wall 12B. The open-close member 20 is disposed on the upper surface of the body 12 in the state where the mount space S over the mount portion 16 is closed. The open-close member 20 rotates about a hinge, not illustrated, disposed at a first end in the transportation direction of the recording media P (that is, the direction of arrow A illustrated in FIG. 3) to open or close the mount space S (refer to FIG. 3) over the mount portion 16.

The rotation member 22 has a function of allowing manually inserted recording media (not illustrated) different from the recording media P to be placed thereon. The rotation member 22 rotates about a hinge, not illustrated, disposed at a first end in the transportation direction of the recording media P (that is, the direction of arrow A illustrated in FIG. 3). The rotation member 22 shifts from the position overlapping the open-close member 20 to the erect position with an operation of the open-close member 20 opening the mount space S.

Structure of Mount Portion 16

Figure 5:
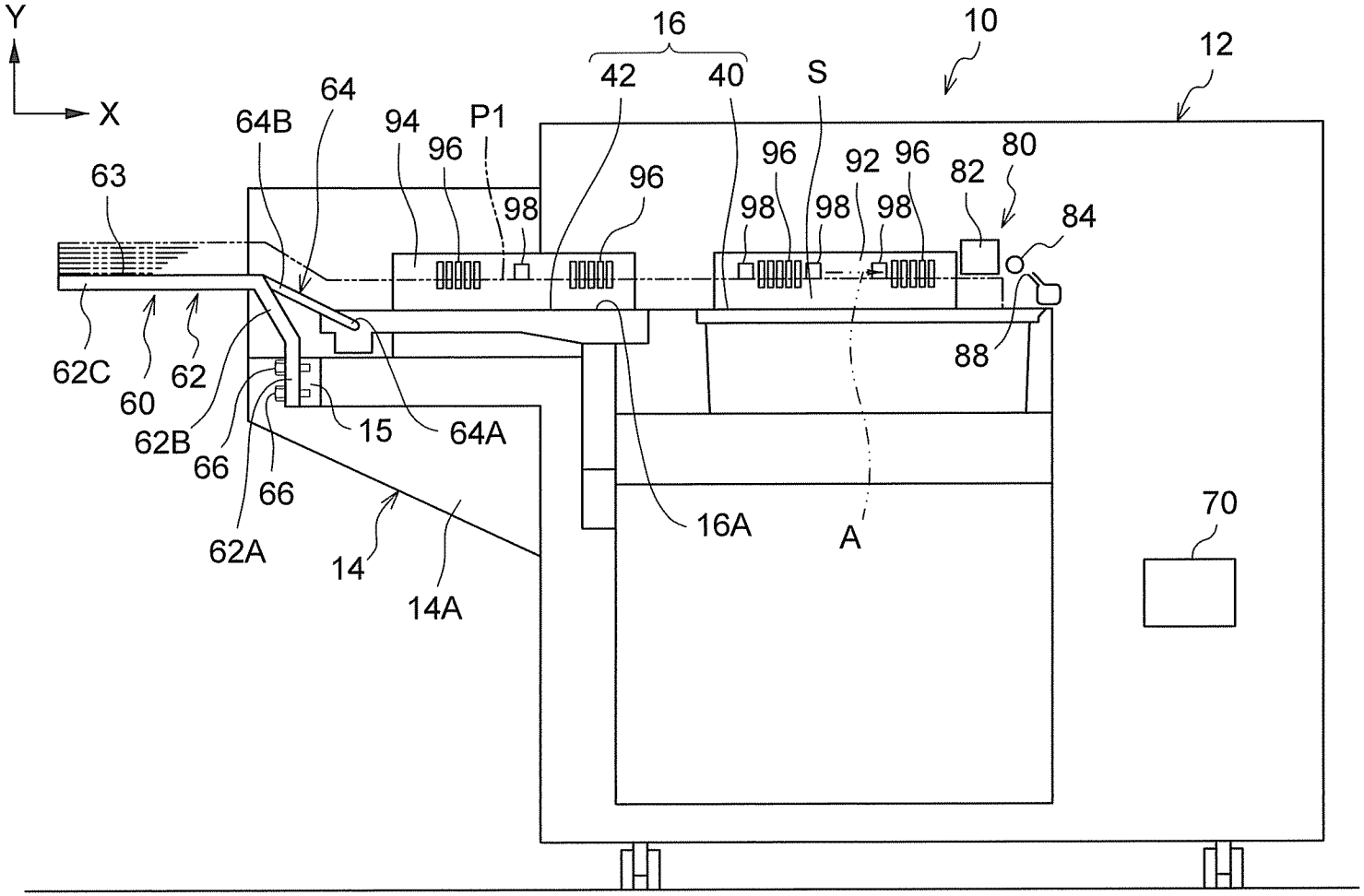
FIG. 5 is a cross-sectional view of recording media stacked on the mount portion and the support portion included in the sheet feeder according to the first exemplary embodiment.

As illustrated in FIGS. 4 and 5, the mount portion 16 includes the body-side mount portion 40 disposed inside the body 12, and the extension-side mount portion 42 extended from the body-side mount portion 40 as a result of the container device 14 being attached to the body 12. When the body-side mount portion 40 and the extension-side mount portion 42 are coupled together in the horizontal direction, the body-side mount portion 40 and the extension-side mount portion 42 are capable of being integrally raised or lowered.

The extension-side mount portion 42 is attached to the side portion of the body-side mount portion 40, to extend from the inside of the body 12 to the inside of the body 14A of the container device 14. In other words, the extension-side mount portion 42 protrudes upstream in the transportation direction of the recording media P (that is, direction of arrow A) from a portion between the front wall 12A and the rear wall 12B (refer to FIG. 3). In the sheet feeder 10, an upper portion of the side wall 12C between the front wall 12A and the rear wall 12B is open toward the upstream side in the transportation direction of the recording media P (refer to FIG. 3), and the extension-side mount portion 42 is disposed over the open portion.

An extension unit 60, serving as an example of a support portion that extends the mount portion 16, is attached to the container device 14 (refer to FIG. 5). The extension unit 60 is optionally attached to the container device 14.

Figure 6:
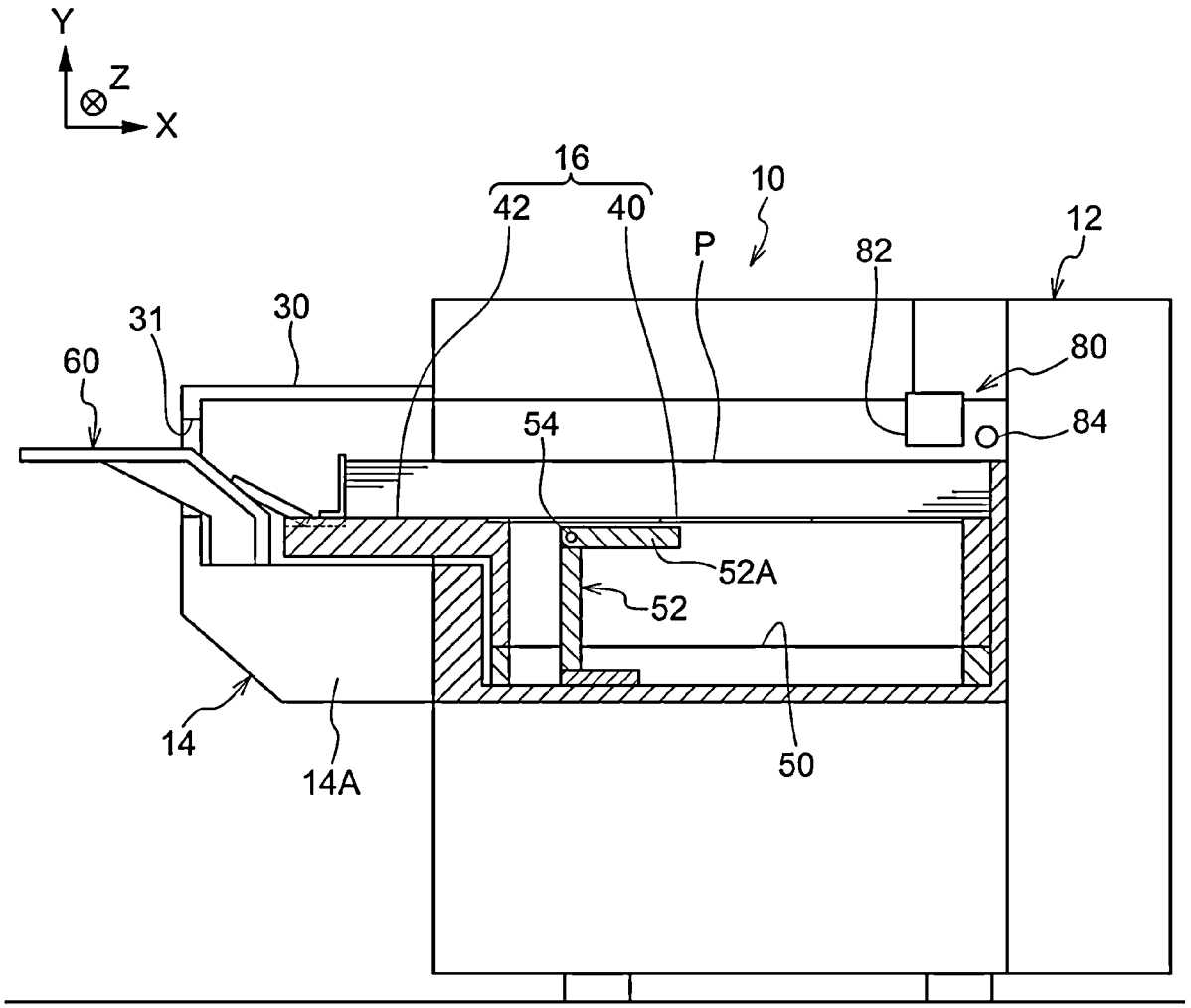
FIG. 6 is a cross-sectional view of recording media stacked on the mount portion included in the sheet feeder according to the first exemplary embodiment.
Figure 7:
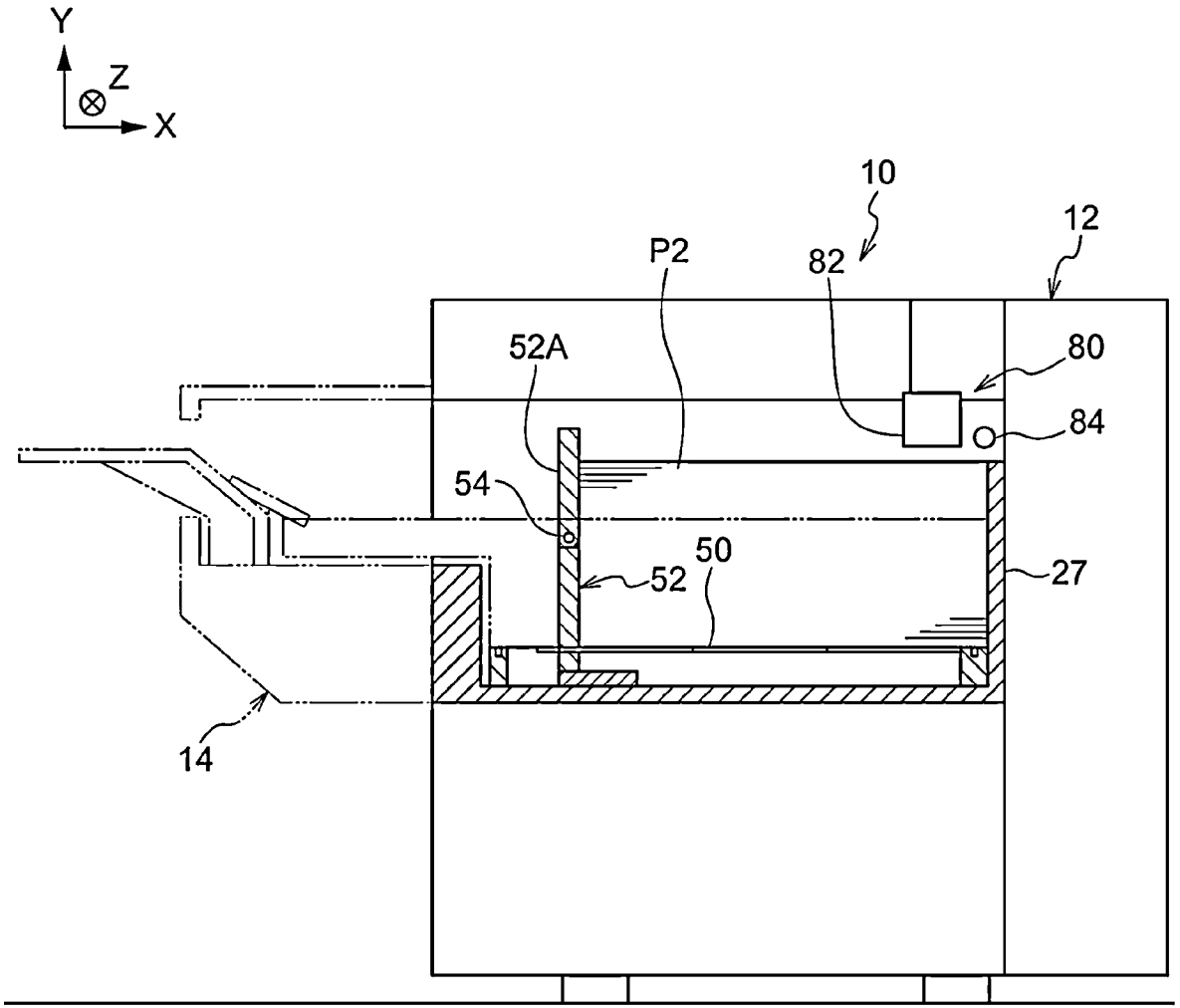
FIG. 7 is a cross-sectional view of the sheet feeder according to the first exemplary embodiment from which a container device is removed.

As illustrated in FIG. 7, when the container device 14 is not attached to the body 12 (in a structure including only the body 12), a mount portion 50 is disposed inside the drawable tray 27 disposed in the body 12. The mount portion 50 is capable of receiving normal-size recording media P2, having a short dimension in the longitudinal direction. An end guide 52 is disposed at the upstream end of the mount portion 50 in the transportation direction of the recording medium P2. The end guide 52 restricts the ends of the recording media P2 in the longitudinal direction. The end guide 52 includes a hinge portion 54 at the middle in the vertical direction. The end guide 52 has an upper piece 52A bendable toward the inner side of the drawable tray 27 (that is, toward the transport portion 80) (refer to FIG. 6).

Examples usable as the normal-size recording media P2 include recording media P2 with a length equal to or smaller than 488 mm in the longitudinal direction. Examples of the recording media P2 with such sizes include A3-size and smaller recording media.

As illustrated in FIG. 6, in the state where the container device 14 is attached to the body 12, the mount portion 16 is capable of receiving long recording media P, longer than the recording media P2 in the longitudinal direction (refer to FIG. 3). When the container device 14 is attached to the body 12, the upper piece 52A of the end guide 52 is bent on the hinge portion 54 of the end guide 52 toward the inner side of the drawable tray 27 (that is, toward the transport portion 80) to fold the end guide 52. In this state, the body-side mount portion 40 is disposed above the end guide 52. The body-side mount portion 40 is, for example, a box-shaped member, and attached to the mount portion 50 to surround the end guide 52.

As illustrated in FIG. 4, an end guide 44 is disposed at the upstream portion of the mount portion 16 in the transportation direction of the recording media P. The end guide 44 restricts the ends of the recording media P in the longitudinal direction. The end guide 44 is removably attached to the extension-side mount portion 42. When the extension unit 60 is attached to the container device 14, the end guide 44 is removed from the extension-side mount portion 42.

As illustrated in FIG. 4, a length L1 of the mount portion 16 in the longitudinal direction is, for example, greater than or equal to 490 mm and smaller than or equal to 900 mm. Thus, the mount portion 16 is capable of receiving long recording media P longer than the A3-size recording media P2 in the longitudinal direction. For example, the mount portion 16 is capable of receiving recording media P with a length longer than or equal to 488 mm and smaller than or equal to 864 mm in the longitudinal direction as an example of the long recording media P.

The sheet feeder 10 includes a lift 100 (refer to FIGS. 10 and 11) that vertically raises or lowers the mount portion 16. For example, the lift 100 raises or lowers the mount portion 50 inside the body 12 to raise the body-side mount portion 40 attached to the mount portion 50 and the extension-side mount portion 42 coupled to the body-side mount portion 40. The lift 100 raises the mount portion 16 to bring the uppermost one of the multiple recording media P stacked on the mount portion 16 to a position at a predetermined height. Here, the lift 100 is an example of a lift portion. The structure of the lift 100 will be described below.

Structure of Extension Unit

As illustrated in FIGS. 4 and 5, the extension unit 60 is connected to a first end of the mount portion 16 in the longitudinal direction (that is, the upstream side in the transportation direction of the recording media P). More specifically, the extension unit 60 is attached to an end portion of the body 14A of the container device 14 away from the body 12, that is, an end portion closer to the extension-side mount portion 42. For example, the extension unit 60 includes a first support portion 62 attached to the body 14A, and a second support portion 64 that obliquely extends between the first support portion 62 and the extension-side mount portion 42.

As illustrated in FIG. 4, the extension unit 60 with a length L2 in the apparatus width direction (direction of arrow X) is added to the mount portion 16 with the length L1 in the longitudinal direction, so that the mount portion 16 and the extension unit 60 are capable of receiving long recording media P1 longer than the recording media P stacked on the mount portion 16 (refer to FIGS. 3 and 6) in the longitudinal direction (refer to FIG. 5). The extension unit 60 is disposed at a first end of the mount portion 16 in the longitudinal direction of the recording medium P1.

As illustrated in FIG. 5, the first support portion 62 is fixed to the body 14A of the container device 14. Specifically, the first support portion 62 is indirectly fixed to the body 12 with the body 14A of the container device 14 interposed therebetween. Thus, the first support portion 62 does not raise regardless of when the mount portion 16 is raised. The first support portion 62 protrudes outward from the body 14A. For example, the first support portion 62 is fixed to a side wall 15 of the body 14A with fasteners 66 such as bolts. The fasteners 66 are an example of fastening portions. When the first support portion 62 is fixed to the side wall 15 of the body 14A, the first support portion 62 extends through a cut portion 31 (refer to FIG. 3) of the closed open-close covering 30.

The first support portion 62 includes a vertical wall portion 62A fixed to the side wall 15 of the body 14A, a sloping portion 62B obliquely extending from the upper end of the vertical wall portion 62A, and an extension portion 62C horizontally extending from the upper end of the sloping portion 62B in a direction away from the vertical wall portion 62A. A mount surface 63 is disposed on the upper surface of the extension portion 62C. The mount surface 63 receives long recording media P1 longer than the recording media P (refer to FIG. 3) in the longitudinal direction.

The second support portion 64 is inclined upgrade from the mount portion 16. The second support portion 64 has a lower end portion 64A in an oblique direction supported by the extension-side mount portion 42, and has an upper end portion 64B in the oblique direction in contact with the sloping portion 62B. Although not illustrated, a protrusion of the lower end portion 64A of the second support portion 64 is inserted into a hole in the extension-side mount portion 42, and the upper end portion 64B of the second support portion 64 is slidable over the sloping portion 62B in this state. Thus, the second support portion 64 that slides over the sloping portion 62B in accordance with a rise of the mount portion 16 gradually reduces its angle of inclination with respect to the horizontal direction.

The mount portion 16 supports part of the recording media P1 stacked thereon from below. The first support portion 62 and the second support portion 64 support another part of the recording media P1 from below while the mount portion 16 is raised. In the present exemplary embodiment, the first support portion 62 and the second support portion 64 support an upstream portion of the recording media P1 in the transportation direction while the mount portion 16 is raised by the lift 100.

As illustrated in FIG. 5, the mount surface 63 of the first support portion 62 is located higher than the position of a mount surface 16A of the mount portion 16 (that is, the upper surface of the mount portion 16) while the recording media P1 are stacked on the mount portion 16. The height of the mount surface 63 of the first support portion 62 is higher than the height of the mount surface 16A of the mount portion 16. Thus, the long recording media P1 form a cranked shape when viewed from the side as illustrated in FIG. 5.

The sheet feeder 10 includes a controller 70 that controls each portion of the sheet feeder 10. The controller 70 has settings of a normal mode for a large quantity of recording media P stacked on the mount portion 16, and a small-quantity mode for a quantity of recording media P stacked on the mount portion 16 smaller than that in the normal mode. Here, the small-quantity mode is a mode for a case where only a small quantity (for example, ten or smaller) of recording media P1 are stacked during stacking of the recording medium P1 (while the open-close member 20 is opened) while the mount portion 16 is lowered.

In the present exemplary embodiment, in the normal mode, the height of the mount surface 63 of the first support portion 62 is higher than the height of a detection position that is to be detected by the sensors 98 (refer to FIG. 4). Specifically, in the normal mode, the height of the mount surface 63 of the first support portion 62 is higher than the height of the mount surface 16A of the mount portion 16. Here, the height of the detection position that is to be detected by the sensors 98 is the height of the uppermost recording medium P1 raised by the lift 100 (refer to FIG. 10) in response to the sensors 98 detecting the lower limit height of the uppermost recording medium P1. Alternatively, the height of the detection position that is to be detected by the sensors 98 may be a height at which the mount portion 16 stops in response to the sensors 98 detecting the uppermost recording medium P1 after the mount portion 16 is lowered to a mount position to receive the recording media P1 (when the open-close member 20 is opened), and the mount portion 16 is then raised after the open-close member 20 is closed.

Figure 9:
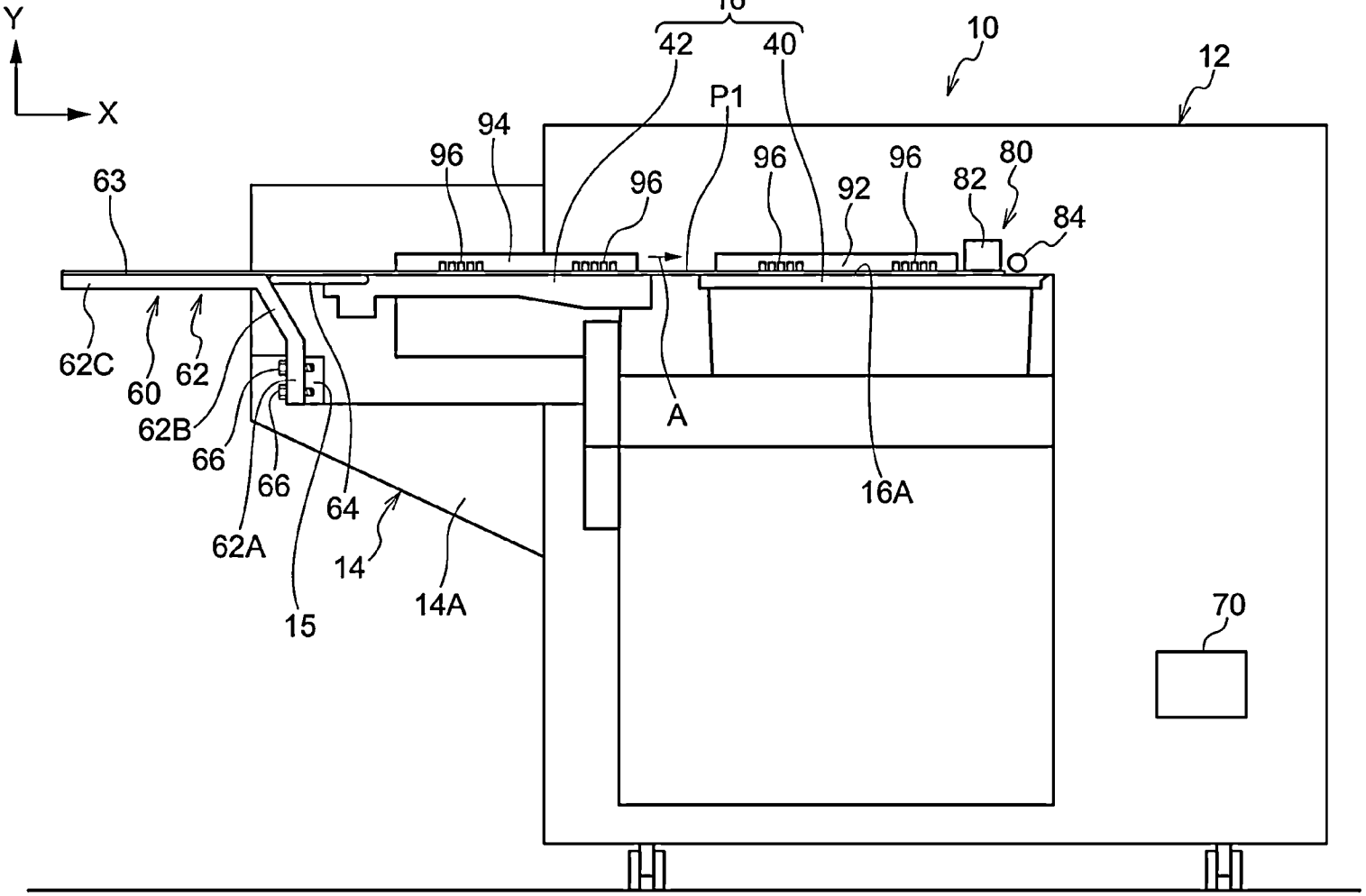
FIG. 9 is a cross-sectional view of the mount portion included in the sheet feeder according to the first exemplary embodiment when raised to the highest position.

In the present exemplary embodiment, in the small-quantity mode, the mount portion 16 is raised to the highest position. For example, in the small-quantity mode, the mount surface 63 of the first support portion 62 and the mount surface 16A of the mount portion 16 may be flush with each other when the mount portion 16 is raised after receiving the recording media P1. For example, as illustrated in FIG. 9, when only one recording medium P is left on the mount portion 16, the mount portion 16 is raised to the highest position, and the mount surface 63 of the first support portion 62 is at the same height as the position of the mount surface 16A of the mount portion 16 (that is, the upper surface of the mount portion 16). Here, the second support portion 64 is disposed upstream in the transportation direction of the recording media P along the mount surface 63 of the extension portion 62C.

The mount portion 16 and the extension unit 60 receive thereon, for example, long recording media P1 with a length in the longitudinal direction longer than 864 mm and equal to or lower than 1500 mm.

Structure of Blowing Portion 96

As illustrated in FIGS. 4 and 5, the blowing portions 96 are disposed in side guides 92 and 94 disposed on both sides of the mount portion 16 in the apparatus depth direction (direction of arrow Z). The side guides 92 and 94 guide side edges of the recording media P1 in the direction crossing the transportation direction of the recording media P1. The side guides 92 and 94 are arranged parallel to each other to extend in the transportation direction of the recording media P1. The side guides 92 and 94 are movable in the apparatus depth direction (direction of arrow Z) in accordance with the size of the recording media P1. The blowing portions 96 are disposed at upper portions of the side guides 92 and 94 to oppose upper ones of the multiple recording media P stacked on the mount portion 16.

Although not illustrated, a blower that feeds air is connected to the blowing portions 96 to allow the blowing portions 96 to blow air. The blowing portions 96 blow air between the multiple recording media P1 from the side edges of the multiple recording media P stacked on the mount portion 16. For example, the multiple blowing portions 96 are disposed in the transportation direction of the recording media P1. For example, two blowing portions 96 are disposed at each of the side guides 92 and 94. For example, the blowing portions 96 are rectangular.

Structure of Transport Portion 80

Figure 8:
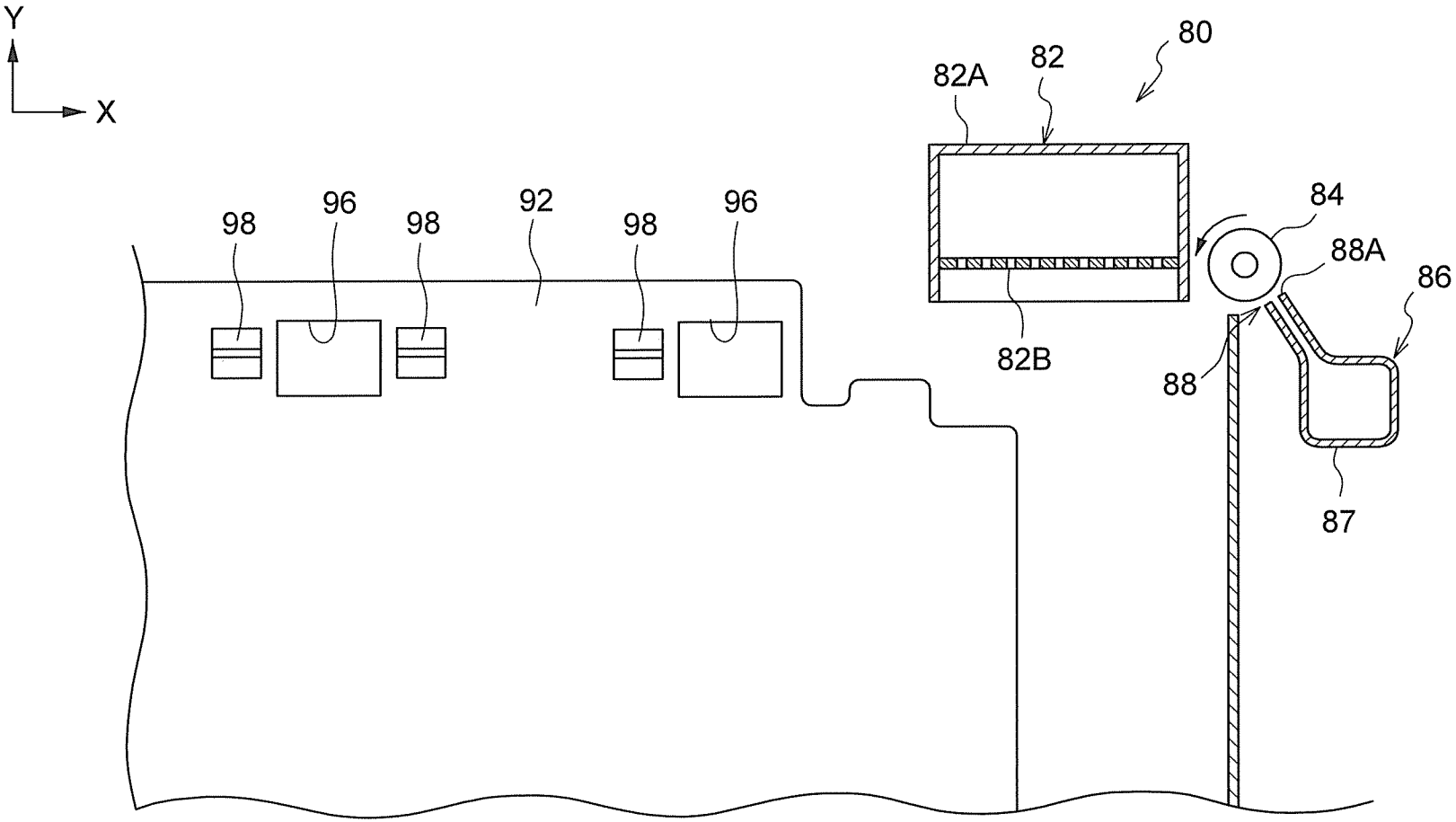
FIG. 8 is a cross-sectional view of a transport portion and a blowing portion of the sheet feeder according to the first exemplary embodiment.

As illustrated in FIG. 8, the transport portion 80 includes a suction portion 82, which sucks from above the uppermost one of the recording media P1 stacked on the mount portion 16, and a transport roller 84, which transports the uppermost one of the recording media P1 stacked on the mount portion 16 (refer to FIG. 5). The transport roller 84 is disposed downstream from the suction portion 82 in the transportation direction of the recording media P1.

The suction portion 82 includes a housing 82A and multiple suction ports 82B disposed in a lower portion of the housing 82A. The suction portion 82 sucks air from the suction ports 82B with a suction device not illustrated to suck the uppermost one of the recording media P1 stacked on the mount portion 16. For example, the suction portion 82 is supported to be movable in the transportation direction of the recording media P1. When the suction portion 82 moves downstream in the transportation direction of the recording media P while sucking the recording medium P1, the suction portion 82 feeds the recording medium P to the transport roller 84.

The transport roller 84 has a function of feeding the uppermost one of the recording media P stacked on the mount portion 16 by rotating in the arrow direction. The transport roller 84 transports the recording medium P toward the image forming apparatus 200 (refer to FIG. 1), that is, in the direction of arrow A.

In the transport portion 80, the suction portion 82 sucks the uppermost one of the recording media P1 stacked on the mount portion 16, and, for example, the suction portion 82 moves downstream in the transportation direction of the recording media P1 to transport the recording media P1 sucked by the suction portion 82 in the direction of arrow A with the transport roller 84 (refer to FIG. 5).

Structure of Blowing Portion 88

As illustrated in FIG. 8, a blowing device 86 is disposed downstream from the transport portion 80 in the transportation direction of the recording media P1. The blowing device 86 includes the blowing portion 88 disposed obliquely below the transport roller 84, and a duct 87 connected to the blowing portion 88. The blowing portion 88 includes an outlet 88A, which discharges air. Although not illustrated, the blowing device 86 includes a blower that feeds air to the duct 87. In the blowing device 86, the blower feeds air to the duct 87, so that the blowing portion 88 blows air between the recording media P stacked on the mount portion 16.

The blowing portion 88 blows air from the downstream side to the upstream side in the transportation direction of the recording media P1. Thus, the blowing portion 88 blows air between the multiple recording media P stacked on the mount portion 16.

As illustrated in FIG. 5, when the transport portion 80 transports the recording media P1, the blowing portion 88 blows air between the multiple recording media P from the downstream side to the upstream side in the transportation direction, and the blowing portions 96 blow air between the multiple recording media P from the side edges of the recording media P1 to facilitate separation between the recording media P1.

Lift

Figure 10:
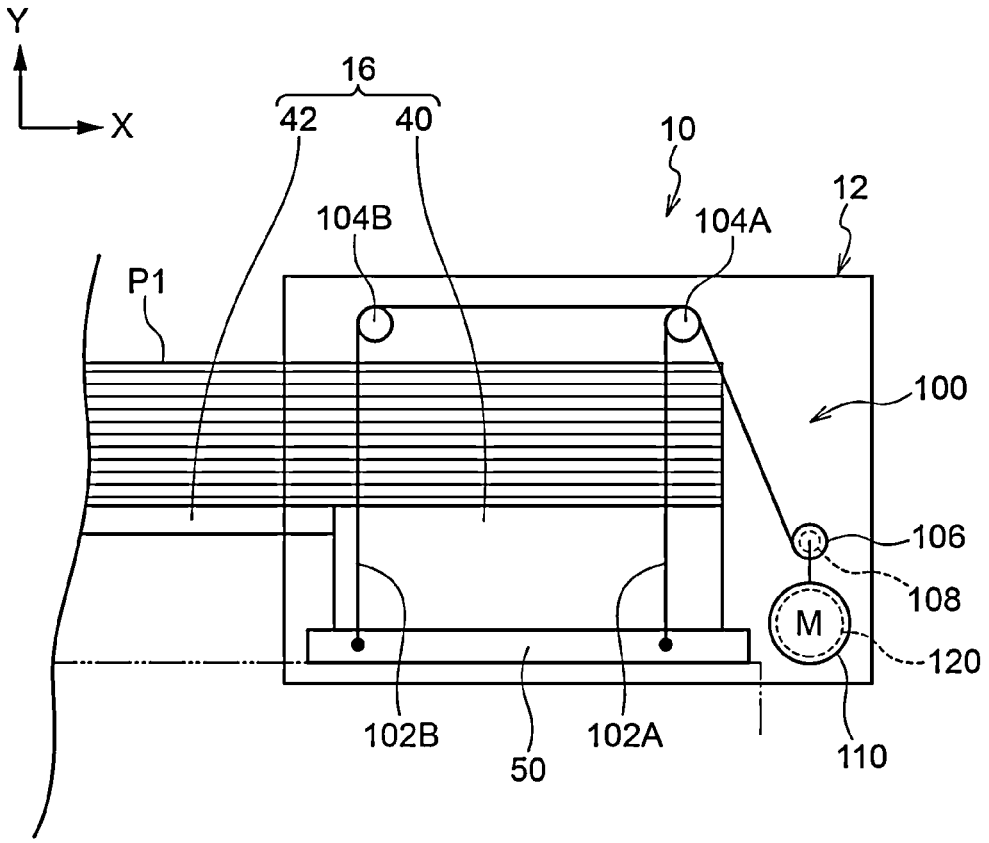
FIG. 10 is a side view of a lift that raises or lowers the mount portion of the sheet feeder receiving the recording media.
Figure 11:
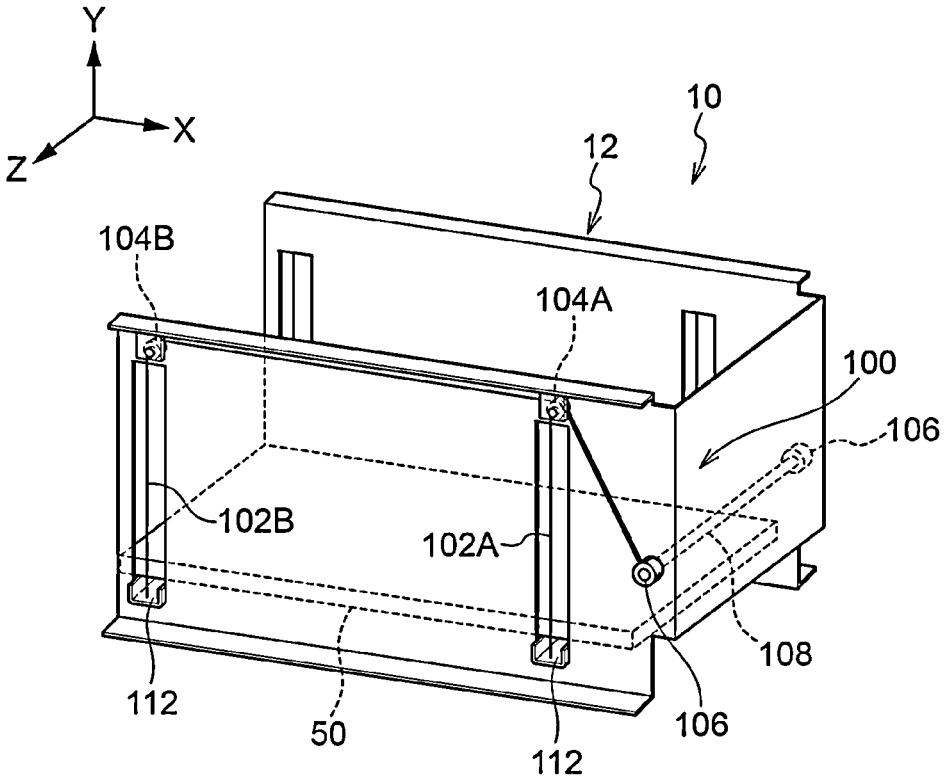
FIG. 11 is a perspective view of a lift that raises or lowers the mount portion of the sheet feeder receiving the recording media.

FIG. 10 is a side view of a structure of the lift 100. FIG. 11 is a perspective view of the structure of the lift 100. FIG. 10 schematically illustrates the structure of the lift 100 for ease of understanding. The lift 100 is exemplarily illustrated, and each component of the lift 100 is changeable.

As illustrated in FIGS. 10 and 11, the lift 100 includes two wires 102A and 102B, coupled to a lower portion of the mount portion 50 on one side in the depth direction (on the near side in the direction of arrow Z in FIG. 11), and pulleys 104A and 104B, disposed at upper portions of the body 12 and around which the wires 102A and 102B are respectively wound. The lift 100 includes a taking-up pulley 106 that takes up the two wires 102A and 102B extending from the pulleys 104A and 104B.

Although not illustrated, the lift 100 also includes two wires 102A and 102B, the pulleys 104A and 104B, and a taking-up pulley 106 (illustrated in FIG. 11) on the other side of the mount portion 16 in the depth direction (on the far side in the direction of arrow Z in FIG. 11). In the lift 100, the taking-up pulleys 106 on both sides in the apparatus depth direction are connected together with a pulley shaft 108. A motor 110 is connected to the taking-up pulleys 106 via a coupling mechanism 120 (refer to FIG. 10). The coupling mechanism 120 connects or disconnects the taking-up pulleys 106 and the motor 110.

As illustrated in FIG. 11, two frames 112 are attached to lower portions of the mount portion 50 to extend in the apparatus depth direction (direction of arrow Z), and the two wires 102A and 102B are respectively coupled to the frames 112. The body-side mount portion 40 is disposed on the mount portion 50, and the extension-side mount portion 42 is coupled to a side portion of the body-side mount portion 40 upstream in the transportation direction of the recording media P. The mount portion 16 including the body-side mount portion 40 and the extension-side mount portion 42 integrated with each other is vertically raised or lowered by the lift 100.

As illustrated in FIG. 4, the sensors 98 that detect the position of the uppermost one of the recording media P stacked on the mount portion 16 are disposed on the side guides 92 and 94 of the sheet feeder 10. When the motor 110 of the lift 100 is rotated in response to detection signals from the sensors 98, the controller 70 of the sheet feeder 10 raises the mount portion 16 to bring the uppermost one of the recording media P to a position at a predetermined height.

Functions and Operations

The functions and operations of the present exemplary embodiment will now be described.

In the sheet feeder 10, the mount portion 16 is disposed in the body 12 and the body 14A of the container device 14 attached to the body 12. The mount portion 16 supports part of the stacked recording media P1 from below. The mount portion 16 is capable of being raised and lowered by the lift 100. The extension unit 60 is connected to the body 14A of the container device 14, and supports another part of the recording media P1 from below while the mount portion 16 is being raised. The mount surface 63 of the extension unit 60 is located higher than the position of the mount surface of the mount portion 16 while the recording media P1 are stacked on the mount portion 16.

In the sheet feeder 10, the blowing portions 96 are disposed in the side guides 92 and 94 to blow air into the side edges of the recording media P stacked on the mount portion 16. In the sheet feeder 10, the blowing portion 88 is disposed obliquely below the transport roller 84 to blow air from the downstream side to the upstream side in the transportation direction of the recording media P stacked on the mount portion 16. In the sheet feeder 10, the transport portion 80 transports the uppermost one of the recording media P1 stacked on the mount portion 16 in the direction of arrow A.

For example, in a structure where the height of the support portion such as the extension unit is lower than the height of the mount portion, a portion of the recording media on the support portion sags with respect to the mount portion. In this state, air blown from the blowing portion 88 fails to pass through the portion of the recording media on the support portion, and the recording media may be transported in an overlapped manner.

In contrast, in the sheet feeder 10, the mount surface 63 of the extension unit 60 is located higher than the position of the mount surface 16A of the mount portion 16 while the recording media P1 are stacked on the mount portion 16. Thus, air easily flows to the portion of the recording media P1 on the extension unit 60. This structure facilitates separation of the upper ones of the recording media P1 stacked on the mount portion 16.

Thus, the sheet feeder 10 prevents the recording media P1 from being transported in an overlapping manner, compared to a case where the support portion supports the recording media at a position lower than the mount portion.

In the sheet feeder 10, the extension unit 60 is disposed at one end of the mount portion 16 in the longitudinal direction of the recording media. Thus, the sheet feeder 10 receives long recording media P1 with a size other than a normal size unlike in a structure where the support portion is disposed in the mount portion.

In the sheet feeder 10, the extension unit 60 supports an upstream portion of the recording media P1 in the transportation direction. Thus, the sheet feeder 10 further facilitates an attachment of the extension unit 60 to the mount portion than in a structure where the support portion supports a downstream portion of the recording media in the transportation direction.

In the sheet feeder 10, the blowing portion 88 blows air from the downstream side to the upstream side in the transportation direction of the recording media P1. Thus, the sheet feeder 10 further facilitates flow of air to the support portion of the recording media P than in a structure where air is blown from the side edges of the recording media.

The sheet feeder 10 includes the sensors 98 that detect the position of the uppermost one of the recording media P stacked on the mount portion 16. The height of the mount surface 63 of the extension unit 60 is higher than the height of the detection position that is to be detected by the sensors 98. Thus, the recording media P1 are more likely to have a portion supported by the mount surface 63 of the extension unit 60 raised higher than a portion supported by the mount portion 16. In other words, the recording media P1 are at least partially prevented from being sagged at the portion on the extension unit 60. Thus, the sheet feeder 10 further facilitates flow of air to a portion of the recording media P1 on the extension unit 60, than in a structure where the height of the support portion is lower than the position of the uppermost one of the recording media.

In the sheet feeder 10, the sensors 98 are disposed at the side guides 92 and 94, which guide the side edges of the recording media P1. Thus, the sheet feeder 10 further facilitates detection of the uppermost one of the recording media P1 than in a structure where the sensors are located at portions other than the side guides. The sensors 98 are disposed at the side guides 92 and 94 movable in accordance with the size of the recording media, and thus are capable of detecting the uppermost one of the recording media of various different sizes with a small quantity of sensors 98.

In the sheet feeder 10, the end guide 52 is folded while the extension unit 60 is connected to the mount portion 16, and the sensors 98 are disposed at the side guides 92 and 94. Thus, the sheet feeder 10 facilitates detection of the uppermost one of the recording media P1 compared to a structure where the end guide is foldable and the sensors are disposed at only the end guide.

The sheet feeder 10 has settings of a normal mode for a large quantity of recording media P stacked on the mount portion 16, and a small-quantity mode for a small quantity of recording media P stacked on the mount portion 16 smaller than that in the normal mode. In the sheet feeder 10, in the normal mode, the height of the mount surface 63 of the extension unit 60 is higher than the height of the detection position that is to be detected by the sensors 98. Thus, the recording media P1 are more likely to be higher at the portion supported by the mount surface 63 of the extension unit 60 than at the portion supported by the mount portion 16. This structure thus at least partially prevents the recording media P1 from sagging at the portion on the extension unit 60. In the normal mode, the sheet feeder 10 facilitates flow of air to the portion of the recording media P1 on the extension unit 60 compared to a case where the height of the support portion is lower than the position of the uppermost one of the recording media.

In the sheet feeder 10, in the small-quantity mode, the height of the mount surface 63 of the extension unit 60 is equal to the height of the detection position that is to be detected by the sensors 98. Thus, in the small-quantity mode, the sheet feeder 10 keeps the height of the entire apparatus lower than a structure where the height of the support portion is higher than the position of the uppermost one of the recording media. In the sheet feeder, in the small-quantity mode, the height of the mount surface 63 of the extension unit 60 may be lower than the detection position that is to be detected by the sensors 98.

In the sheet feeder 10, the extension unit 60 supports the end portions of the recording media P1 longer than A3-size media in the longitudinal direction. Thus, the sheet feeder 10 is capable of receiving the recording media P1 longer than A3-size media.

In the sheet feeder 10, the extension unit 60 is fixed to the body 14A of the container device 14 with the fasteners 66. Thus, the sheet feeder 10 has a simpler structure than a structure where the support portion is fixed to the mount portion.

In the sheet feeder 10, the transport portion 80 includes the transport roller 84 that transports the uppermost one of the recording media P1 stacked on the mount portion 16. Thus, the sheet feeder 10 prevents the recording media P1 from being transported in an overlapped manner when the mount portion is extended with the extension unit 60.

In the sheet feeder 10, the transport portion 80 includes the suction portion 82 that sucks the uppermost one of the recording media P1 stacked on the mount portion 16 from above. The sheet feeder 10 thus further prevents the recording media P1 from being transported in an overlapping manner, than a structure that does not suck the uppermost one of the recording media stacked on the mount portion.

The image forming apparatus 200 includes the sheet feeder 10, from which the recording media P1 are transported to the image forming apparatus body 202. Thus, the image forming apparatus 200 further prevents the recording media P1 from being transported in an overlapping manner, than in a case where the support portion supports from below the recording media at a portion lower than the mount portion.

Second Exemplary Embodiment

Figure 12:
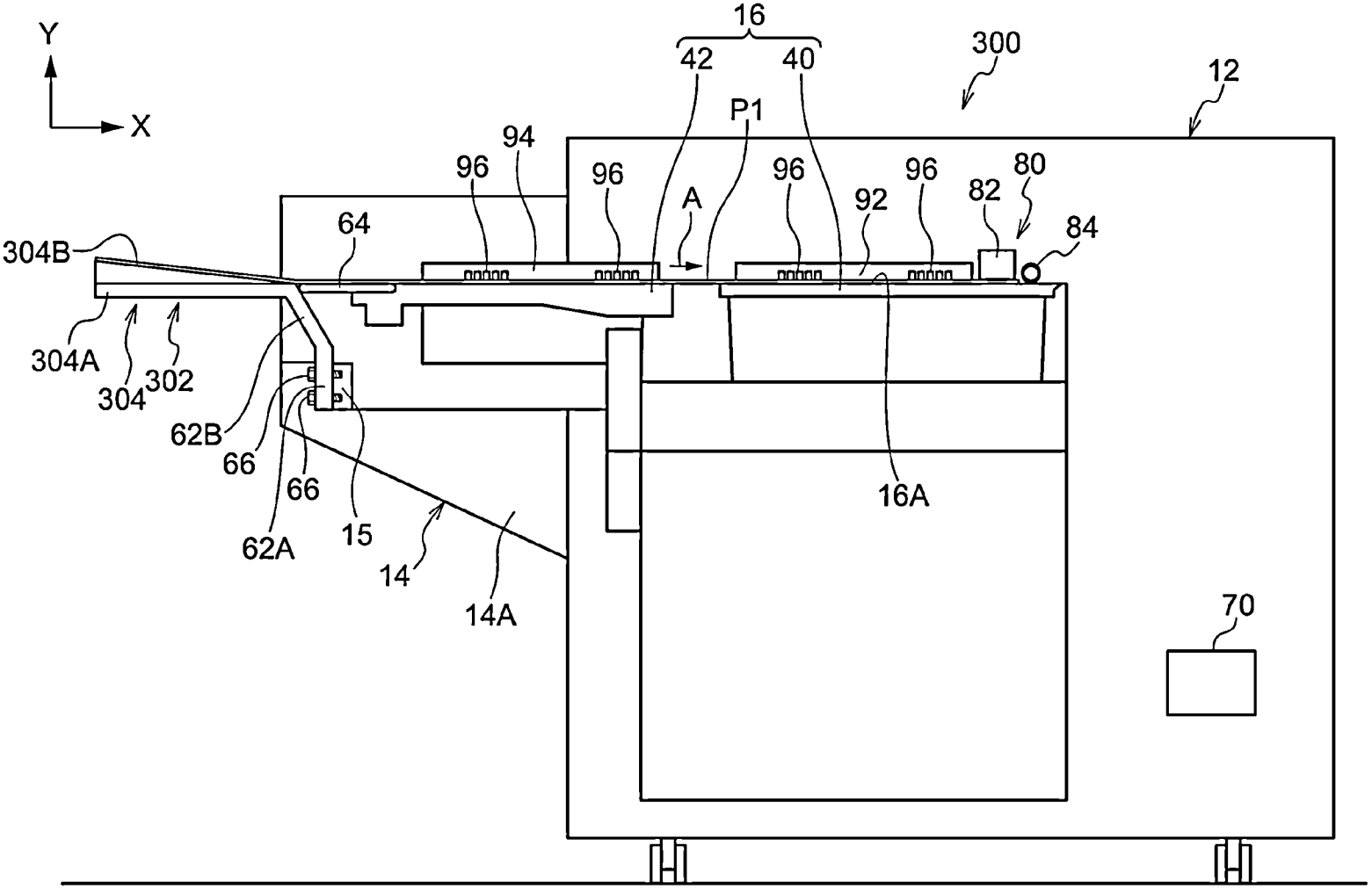
FIG. 12 is a cross-sectional view of a mount portion and a support portion included in a sheet feeder according to a second exemplary embodiment.

FIG. 12 illustrates a sheet feeder 300, serving as an example of a feeder according to a second exemplary embodiment. Components that are the same as those of the first exemplary embodiment are denoted with the same reference signs without description.

As illustrated in FIG. 12, the sheet feeder 300 includes an extension unit 302, as an example of a support portion connected to the body 14A of the container device 14. In the sheet feeder 300, the mount portion 16 supports part of the recording media P1. The extension unit 302 supports another part of the recording media P1 from below while the mount portion 16 is being raised. The extension unit 302 includes a first support portion 304 and a second support portion 64. The first support portion 304 includes a vertical wall portion 62A, a sloping portion 62B, and an extension portion 304A extending from the upper end of the sloping portion 62B in a direction away from the vertical wall portion 62A. The extension portion 304A includes a slope 304B inclined upgrade in a direction away from the body 14A of the container device 14 (to the upstream side in the longitudinal direction of the recording media P1). The slope 304B is located higher than the mount surface 16A of the mount portion 16 while the recording media P1 are stacked on the mount portion 16.

Other components of the sheet feeder 300 are the same as those of the sheet feeder 10 according to the first exemplary embodiment.

The sheet feeder 300 has the following operations and functions in addition to the operations and functions of the structure of the sheet feeder 10 according to the first exemplary embodiment.

In the sheet feeder 300, the extension portion 304A includes the slope 304B inclined upgrade in a direction away from the body 14A of the container device 14. Thus, the portion of the recording media P1 supported by the extension portion 304A is further raised along the slope 304B toward the upstream end of the recording media P1 in the longitudinal direction. Thus, the sheet feeder 300 facilitates flow of air to the portion of the recording media P1 closer to the first support portion 304 of the extension unit 302, compared to the structure where the support portion is horizontal.

Third Exemplary Embodiment

Figure 13:
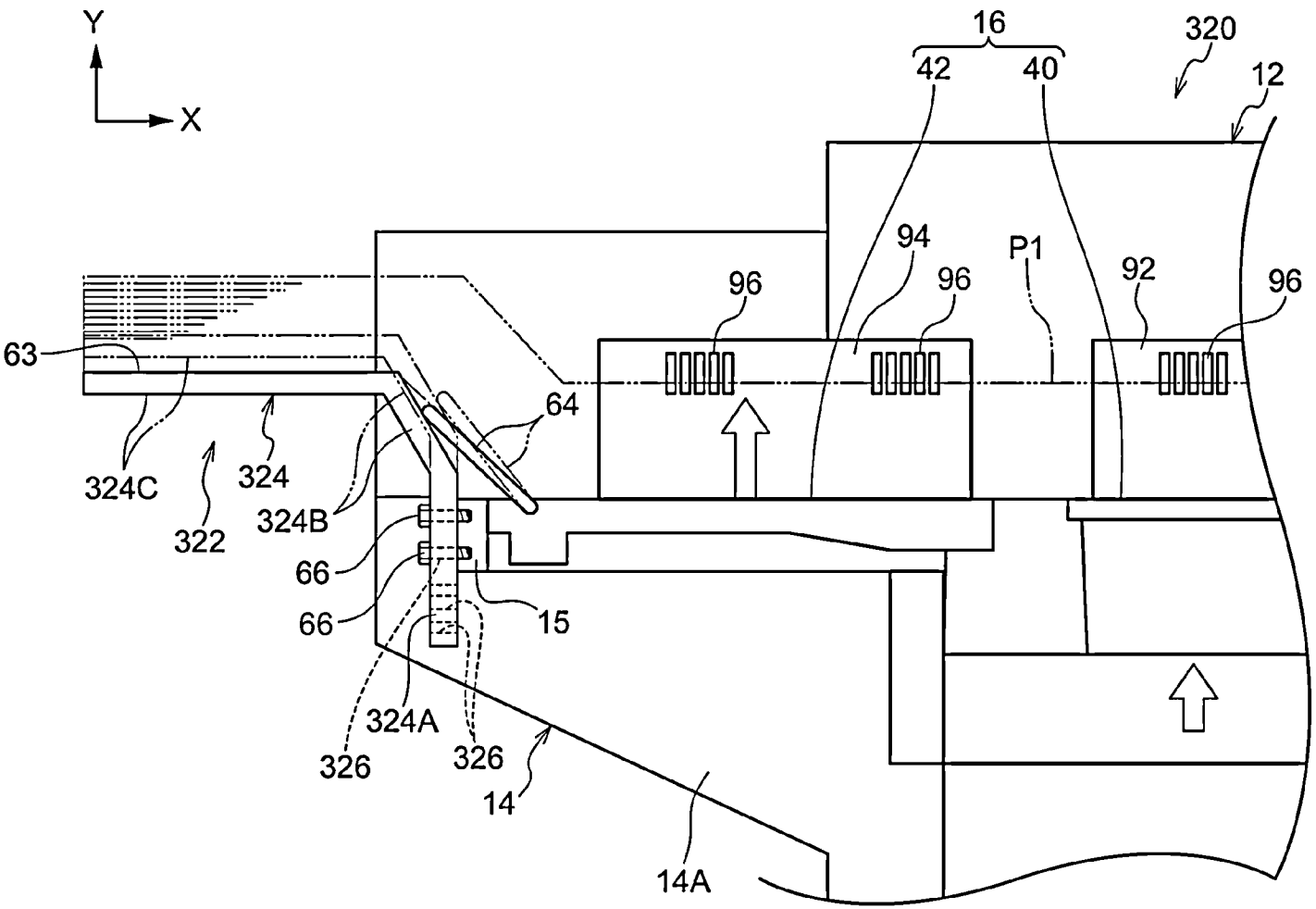
FIG. 13 is an enlarged cross-sectional view of part of the mount portion and a support portion included in a sheet feeder according to a third exemplary embodiment.

FIG. 13 illustrates a sheet feeder 320 serving as an example of a feeder according to a third exemplary embodiment. Components the same as those of the first and second exemplary embodiments are denoted with the same reference sigs without description.

As illustrated in FIG. 13, the sheet feeder 320 includes an extension unit 322 as an example of a support portion connected to the body 14A of the container device 14. In the sheet feeder 320, the mount portion 16 supports part of the recording media P1. The extension unit 322 supports another part of the recording media P1 from below while the mount portion 16 is raised. The extension unit 322 includes a first support portion 324 and a second support portion 64. The first support portion 324 includes a vertical wall portion 324A fixed to the side wall 15 of the body 14A, a sloping portion 324B obliquely extending from the upper end of the vertical wall portion 324A, and an extension portion 324C extending from the upper end of the sloping portion 324B in the horizontal direction away from the vertical wall portion 324A.

The vertical wall portion 324A includes multiple through-holes 326 arranged in the vertical direction. Fasteners 66 are inserted into the through-holes 326 in the vertical wall portion 324A, and fastened to the side wall 15 of the body 14A, to fix the first support portion 324 to the side wall 15 of the body 14A. The multiple through-holes 326 in the vertical wall portion 324A arranged in the vertical direction enable adjustment of the vertical position of the mount surface 63 of the first support portion 324 with respect to the body 14A based on the positions of the through-holes 326 through which the fasteners 66 extend.

Other components of the sheet feeder 320 are the same as those of the sheet feeder 10 according to the first exemplary embodiment.

The sheet feeder 320 has the following operations and functions in addition to the operations and functions of the structure of the sheet feeder 10 according to the first exemplary embodiment.

In the sheet feeder 320, the first support portion 324 is fixed to the body 14A of the container device 14 while enabling adjustment of the height of the mount surface 63. Thus, the sheet feeder 320 facilitates flow of air toward the portion of the recording media P1 on the extension unit 322 compared to a structure where the height of the support portion is not adjustable.

Supplementary Explanation

In the sheet feeder according to each of the first to third exemplary embodiments, the mount portion 16 is disposed to extend between the body 12 and the body 14A of the container device 14, and the extension unit 60, 302, or 322 serving as a support portion is connected to the body 14A of the container device 14, but the present disclosure is not limited to this structure. For example, the support portion may be directly connected to the sheet feeder body without a container device interposed therebetween.

In the sheet feeder according to each of the first to third exemplary embodiments, the extension unit 60, 302, or 322 includes two components, but the present disclosure is not limited to this structure. For example, a support portion including a single component may be connected to the body.

In the sheet feeder according to each of the first to third exemplary embodiments, the sensors 98 that detect the position of the uppermost one of the recording media P1 are disposed at the side guides 92 and 94, but the present disclosure is not limited to this structure. For example, in a structure where an end guide is not folded while the support portion is connected to the body, a sensor that detects the position of the uppermost one of the recording media P1 may be disposed at the end guide. Alternatively, sensors may be disposed at both the end guide and the side guides and used in different occasions, such as the sensor at the end guide may be used while the end guide is in an erect position, and the sensors at the side guides may be used while the end guide is folded.

The sheet feeder according to each of the first to third exemplary embodiments include both the blowing portion 88 and the blowing portions 96, but the present disclosure is not limited to this structure. For example, blowing portions may be disposed at only the sides of the recording media. In this case, the blowing portions are preferably disposed to blow air toward the upstream side of the recording media.

In the sheet feeder according to each of the first to third exemplary embodiments, sheets or other materials are used as the recording media P, but the present disclosure is not limited to this structure. For example, a feeder according to any aspect of the present disclosure is applicable to sheet-shaped media other than recording media such as sheets (for example, applicable to metal sheets, resin sheets, or sheets of cloth).

In the sheet feeder according to the third exemplary embodiment, the height of the first support portion 324 of the extension unit 322 is adjusted by changing the through-holes 326 through which the fasteners 66 extend, but the present disclosure is not limited to this structure. For example, the vertical height of the support portion with respect to the body may be adjusted using a fastening portion such as a clip.

The present disclosure is described in detail using specific exemplary embodiments, but the present disclosure is not limited to these exemplary embodiments. It is apparent to practitioners skilled in the art that various other exemplary embodiments will be possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A feeder comprising:

a body;

a mount portion disposed in the body and comprising a mount surface configured to support from below part of recording media stacked thereon;

a lift that raises the mount portion;

a support portion being an extension of the mount portion and connected to the body to support from below another part of the recording media while the mount portion is raised, the support portion being located higher than a position of the mount surface of the mount portion while the recording media are stacked on the mount portion;

a blowing portion comprising an outlet that discharges and blows air between the recording media stacked on the mount portion;

a transport portion comprising a suction portion that sucks and transports an uppermost one of the recording media stacked on the mount portion, wherein the suction portion comprises a housing and a plurality of suction ports disposed in a lower portion of the housing; and a sensor that detects a position of an uppermost one of the recording media stacked on the mount portion, wherein a height of the support portion is higher than a height of a detection position that is to be detected by the sensor, which is a height of an uppermost one of the recording media stacked on the mount portion detected by the sensor.

2. The feeder according to claim 1, wherein the support portion is disposed at a portion of the mount portion closer to a first end of the recording media in a longitudinal direction of the recording media.

3. The feeder according to claim 2, wherein the support portion supports an upstream portion of the recording media in a transportation direction of the recording media.

4. The feeder according to claim 3, wherein the blowing portion blows air from a downstream side to an upstream side in the transportation direction of the recording media.

5. The feeder according to claim 4, further comprising:

a sensor that detects a detection position of an uppermost one of the recording media stacked on the mount portion, wherein a height of the support portion is higher than a height of the detection position that is to be detected by the sensor, which is a height of an uppermost one of the recording media stacked on the mount portion detected by the sensor.

6. The feeder according to claim 3, further comprising:

a sensor that detects a detection position of an uppermost one of the recording media stacked on the mount portion, wherein a height of the support portion is higher than a height of the detection position that is to be detected by the sensor, which is a height of an uppermost one of the recording media stacked on the mount portion detected by the sensor.

7. The feeder according to claim 2, further comprising:

a sensor that detects a detection position of an uppermost one of the recording media stacked on the mount portion, wherein a height of the support portion is higher than a height of the detection position that is to be detected by the sensor, which is a height of an uppermost one of the recording media stacked on the mount portion detected by the sensor.

8. The feeder according to claim 7, wherein the sensor is disposed at an end guide that guides a trailing end of the recording media or at a side guide that guides a side edge of the recording media.

9. The feeder according to claim 1, wherein the sensor is disposed at an end guide that guides a trailing end of the recording media or at a side guide that guides a side edge of the recording media.

10. The feeder according to claim 9, wherein the end guide is folded while the support portion is connected to the mount portion, and wherein the sensor is disposed on the side guide.

11. The feeder according to claim 1, wherein the feeder has settings of a normal mode where a quantity of the recording media stacked on the mount portion is large, and a small-quantity mode where a quantity of the recording media stacked on the mount portion is smaller than the quantity of the recording media in the normal mode, and wherein, in the normal mode, the height of the support portion is higher than the height of the detection position that is to be detected by the sensor.

12. The feeder according to claim 11, wherein, in the small-quantity mode, the height of the support portion is lower than or equal to the height of the detection position that is to be detected by the sensor.

13. The feeder according to claim 1, wherein the support portion supports an end portion of the recording media in a longitudinal direction having a size longer than an A3 size.

14. The feeder according to claim 1, wherein the support portion is fixed to the body with a fastening portion.

15. The feeder according to claim 14, wherein the support portion is fixed to the body while having a height thereof adjustable.

16. The feeder according to claim 1, wherein the support portion includes a slope inclined upgrade in a direction away from the body.

17. The feeder according to claim 1, wherein the transport portion includes a transport roller that transports an uppermost one of the recording media stacked on the mount portion.

18. An image forming apparatus, comprising:

the feeder according to claim 1; and an image forming unit to which the recording media are transported from the feeder.

* * * * *